US009196184B2

(12) United States Patent
Moon et al.

(10) Patent No.: US 9,196,184 B2
(45) Date of Patent: Nov. 24, 2015

(54) METHOD OF DRIVING DISPLAY PANEL AND DISPLAY APPARATUS FOR PERFORMING THE SAME

(75) Inventors: Gyeong-Ub Moon, Suwon-si (KR); Hyun-Seok Ko, Yongin-si (KR); Jung-Hwan Cho, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 668 days.

(21) Appl. No.: 13/474,369

(22) Filed: May 17, 2012

(65) Prior Publication Data

US 2013/0100122 A1 Apr. 25, 2013

(30) Foreign Application Priority Data

Oct. 25, 2011 (KR) ..... 10-2011-0109182

(51) Int. Cl.

| | |
|---|---|
| ***G09G 3/00*** | (2006.01) |
| ***G09G 3/34*** | (2006.01) |
| ***G09G 3/36*** | (2006.01) |

(52) U.S. Cl.

CPC ..... *G09G 3/003* (2013.01); *G09G 3/3406* (2013.01); *G09G 3/3648* (2013.01); *G09G 2310/0224* (2013.01)

(58) Field of Classification Search

None

See application file for complete search history.

(56) References Cited

U.S. PATENT DOCUMENTS

| | | | | |
|---|---|---|---|---|
| 5,083,851 | A | 1/1992 | MacDonald | |
| 7,825,999 | B2 | 11/2010 | Chestak et al. | |
| 2008/0303962 | A1 * | 12/2008 | Tomita et al. | 349/8 |
| 2010/0245693 | A1 * | 9/2010 | MacNaughton et al. | 349/13 |
| 2010/0265230 | A1 * | 10/2010 | Kang | 345/211 |
| 2011/0128269 | A1 | 6/2011 | Lee et al. | |

FOREIGN PATENT DOCUMENTS

| | | |
|---|---|---|
| KR | 100823016 | 4/2008 |

* cited by examiner

*Primary Examiner* — Said Broome

(74) *Attorney, Agent, or Firm* — H.C. Park & Associates, PLC

(57) ABSTRACT

Provided is a method of driving a display panel, including: outputting first data voltages representing a left-eye image or a right-eye image to first signal lines among a plurality of signal lines of the display panel during a first period of a frame for rendering the left-eye or right-eye image of a three-dimensional (3D) image; outputting second data voltages representing the left-eye image or right-eye image for second signals among the plurality of signal lines of the display panel during a second period of the frame for rendering the left-eye or right-eye image of the 3D image; and stopping the data voltages from being outputted to the display panel during a third period of the frame.

20 Claims, 10 Drawing Sheets

METHOD OF DRIVING DISPLAY PANEL AND DISPLAY APPARATUS FOR PERFORMING THE SAME

This application claims priority from and the benefit of Korean Patent Application No. 10-2011-0109182, filed on Oct. 25, 2011, which is hereby incorporated by reference for all purposes as if fully set forth herein.

BACKGROUND OF THE INVENTION

1. Field of Invention

Exemplary embodiments of the present invention relate to a method of driving a display panel and a display apparatus for performing the above-mentioned method. More particularly, exemplary embodiments of the present invention relate to a method of driving a display panel for enhancing the display quality of a three-dimensional ("3D") image and a display apparatus for performing the above-mentioned method.

2. Discussion of Background

Generally, a liquid crystal display ("LCD") displays two-dimensional ("2D") images. Recently, LCDs for displaying 3D images have been developed due to high demands for 3D displays in various areas such as games, movies, and the like.

A typical 3D image display apparatus displays 3D images based on the principle of binocular parallax, i.e., an optical phenomenon that the left and right eyes of humans have different views of an object from each other. More specifically, because the two eyes of humans are spaced apart from each other, an object is viewed from different angles, and the image of the object perceived from the different angles is inputted to the brain of the observer to create a 3D image. Based on this principle, the observer can recognize stereoscopic images based on the 3D images displayed on the display apparatus.

Typically, stereoscopic image display apparatuses can be classified into the stereoscopic type using spectacles and the auto-stereoscopic type that does not require spectacles. The stereoscopic type includes the passive polarized glasses method with a polarized filter having different polarized axes according to the two eyes, and the active shutter glasses method. In the active shutter glasses method, a left-eye frame image and a right-eye frame image are time-divided to be periodically displayed, and a pair of glasses is used to sequentially open or close the left-eye shutter and the right-eye shutter respectively synchronized with left-eye and right-eye periods.

A conventional stereoscopic image display apparatus has crosstalk caused by a left-eye image being mixed with a right-eye image due to a slow liquid crystal response time. When a stereoscopic image display apparatus displays a left-eye or right-eye image along the scan direction which typically progresses from the upper area toward the lower area of the stereoscopic image display apparatus, crosstalk is observed more heavily at the lower area than at the upper area. As described above, the display quality of the 3D stereoscopic image may be degraded by such crosstalk as is observed in a particular area.

SUMMARY OF THE INVENTION

Exemplary embodiments of the present invention provide a method of driving a display panel capable of enhancing the display quality of 3D stereoscopic images.

Exemplary embodiments of the present invention also provide a display apparatus for performing the method of driving the display panel.

An exemplary embodiment of the present invention provides a method of driving a display panel, the method comprising: outputting first data voltages representing a left-eye image or a right-eye image to first signal lines among a plurality of signal lines of the display panel during a first period of a frame for rendering the left-eye image or the right-eye image of a three-dimensional (3D) image; outputting second data voltages representing the left-eye or right-eye image for second signal lines among the plurality of signal lines of the display panel during a second period of the frame for rendering the left-eye or right-eye image of the 3D image; and stopping the data voltages from being outputted to the display panel during a third period of the frame.

An exemplary embodiment of the present invention provides a display apparatus comprising: a display panel comprising a plurality of signal lines; and a data driving part configured to output data voltages representing a left-eye image or a right-eye image to first lines among the plurality of signal lines of the display panel during a first period of a frame for rendering the left-eye or right-eye image of a 3D image, configured to output data voltages representing the left-eye or right-eye image data to second lines among the plurality of signal lines of the display panel during a second period of the frame, and stopping the data voltages from being outputted to the display panel during a third period of the frame.

An exemplary embodiment of the present invention provides a method of driving a display panel comprising gate lines, data lines and pixels that are arranged as a matrix type, the method comprising: generating first gate signals for a first group of gate lines and sequentially providing the same to the first group of gate lines in a first sub-frame of a first frame; generating first data signals for a left-eye image of a 3D image and providing the same through the data lines to pixels connected to the first group of gate lines in synchronization with the first gate signals; generating second gate signals for a second group of gate lines and sequentially providing the same to the second group of gate lines in a second sub-frame of the first frame; and generating second data signals for the left-eye image and providing the same through the data lines to pixels connected to the second group of gate lines in synchronization with the second gate signals, wherein the gate lines of the first group are interleaved with the gate lines of the second group.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
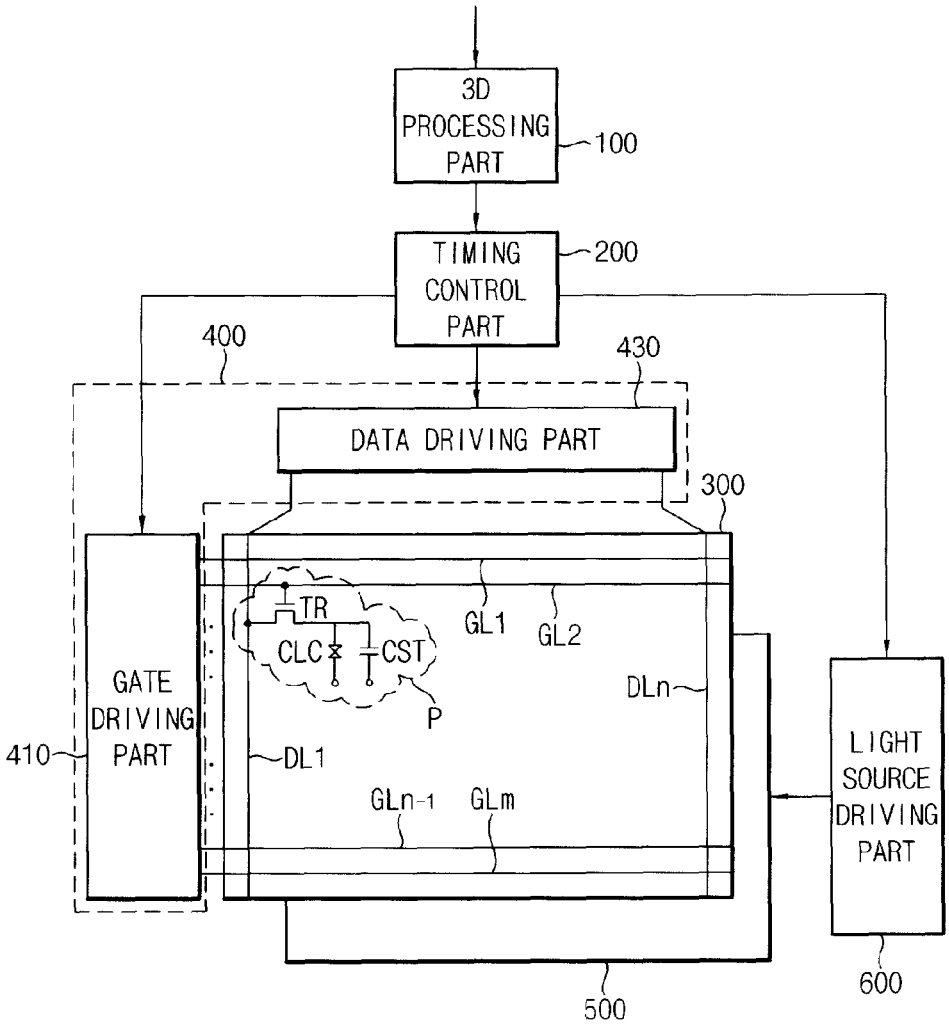
FIG. 1 is a block diagram illustrating a display apparatus according to an exemplary embodiment of the present invention.
Figure 1:
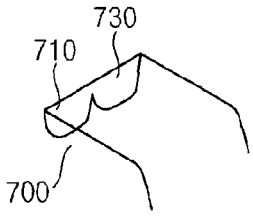

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of areas and regions may be exaggerated for clarity.

FIG. 1 is a block diagram illustrating a display apparatus according to an exemplary embodiment of the present invention.

Referring to FIG. 1, in accordance with one exemplary embodiment, the display apparatus may include a three-dimensional ("3D") processing part 100, a timing control part 200, a display panel 300, a panel driving part 400, a light source part 500, and a light source driving part 600. The display apparatus may include a glasses part 700.

The 3D processing part 100 processes the source data received in the unit of frames into 3D image data in a 3D image mode. The 3D processing part 100 divides the source data frame into left-eye data and right-eye data and respectively scales the left-eye and right-eye data into left-eye and right-eye data frames corresponding to the resolution of the display panel 300. The 3D processing part 100 sequentially outputs the left-eye data frame and the right-eye data frame.

The timing control part 200 may include a memory storing the source image data when the source image data is received in a progressive scan mode.

The timing control part 200 receives image data in the unit of a frame, divides the image data in the frame unit into first partial data corresponding to a first part among a plurality of horizontal lines included in the display panel 300 and second partial data corresponding to a second part among the horizontal lines, and sequentially outputs the first partial data and the second partial data. For example, the timing control part 200 divides the image data of one frame unit into odd-numbered data corresponding to odd-numbered horizontal lines and even-numbered data corresponding to even-numbered horizontal lines and sequentially outputs the odd-numbered data and the even-numbered data. Hereinafter, the first part is referred to as the odd-numbered and the second partial part is referred to as the even-numbered. Alternatively, the first part may be referred to as the even-numbered and the second part may be referred to as the odd-numbered. The first and second parts of the horizontal lines, however, are not limited to be odd- or even-numbered horizontal lines, and any signal lines may be grouped into the first and second parts as long as the signal lines of the first part are interleaved with the signal lines of the second part. For instance, every first and second signal lines may constitute the first part, while every third signal line constitute the second part. Also, although the term "horizontal line" is frequently used throughout the specification for simplicity of descriptions, any signal lines such as gate lines and data lines may be referred to as horizontal lines. Horizontal lines are not limited to signal lines disposed horizontally and may even include signal lines disposed vertically depending on the reference. Likewise, the term "row" may be used interchangeably with "column," and the term "odd" may be used interchangeably with "even" throughout the specification.

The timing control part 200 controls the panel driving part 400 so that the panel driving part 400 individually drives odd-numbered pixel rows corresponding to the odd-numbered horizontal lines of the display panel 300 and an even-numbered pixel row corresponding to the even-numbered horizontal line of the display panel 300.

The display panel 300 includes a plurality of horizontal lines, which may be horizontally- or vertically-disposed signals such as gate lines and data lines. For example, the display panel 300 includes first to n-th data lines DL1, . . . , DLn (n is a natural number), first to m-th gate lines GL1, . . . , GLm (m is a natural number), and a plurality of pixels P. The first to n-th data lines DL1, . . . , DLn are extended in a first direction D1 and arranged in a second direction D2 crossing the first direction D1. The first to m-th gate lines GL1, . . . , GLm are extended in the second direction D2 and arranged in the first direction D1. The pixels are arranged as a matrix type which includes a plurality of pixel rows and a plurality of pixel columns. The pixel rows correspond to the horizontal lines. For example, the display panel 300 may include M pixel rows and N pixel columns (M and N are natural numbers). Each pixel P may include a switching element TR connected to a gate line and a data line, a liquid crystal capacitor CLC connected to the switching element TR, and a storage capacitor CST.

The panel driving part 400 includes a gate driving part 410 and a data driving part 430. In one exemplary embodiment, the panel driving part 400 may drive the odd-numbered pixel rows of the display panel 300 during a first period of a frame and drive the even-numbered pixel rows of the display panel 300 during a second period of the frame. One of ordinary skill in the art will appreciate that the panel driving part 400 may alternatively drive the even-numbered pixel rows during the first period of the frame, while driving the odd-numbered pixel rows during the second period.

The gate driving part 410 provides first to m-th gate signals to the first to m-th gate lines GL1, . . . , GLm. For example, the gate driving part 410 sequentially provides gate signals to the odd-numbered gate lines during the first period of the frame and sequentially provides gate signals to the even-numbered gate lines during the second period of the frame, according to the control signals of the timing control part 200. The odd-numbered gate lines are electrically connected to the pixels included in the odd-numbered pixel rows, and the even-numbered gate lines are electrically connected to the pixels included in the even-numbered pixel rows.

The gate driving part 410 may be disposed in the peripheral area of the display panel 300 adjacent to an end portion of the first to m-th gate lines GL1, . . . , GLm, for instance, in a single structure. Alternatively, the gate driving part 410 may be disposed in the peripheral area of the display panel 300 adjacent to both end portions of the first to m-th gate lines GL1, . . . , GLm, for instance, in a dual structure. The gate driving part 410 of the dual structure may include a first gate driving part for providing gate signals to the odd-numbered gate lines and a second gate driving part for providing gate signals to the even-numbered gate lines.

The gate driving part 410 may be mounted on the display panel 300 such as in the type of a chip, or may integrally be formed on the display panel 300 via substantially the same process as that for forming the switching element TR of the pixel P.

The data driving part 430 converts line data for horizontal lines received from the timing control part 200 into data voltages, for instance, in the analog type and provides the data voltages to the first to N-th data lines DL1, . . . , DLn.

The data driving part 430 outputs the data voltages to the pixels of the odd-numbered pixel rows corresponding to the odd-numbered horizontal lines during the first period of the frame and outputs the data voltages to the pixels of the even-numbered pixel rows corresponding to the even-numbered horizontal lines during the second period of the frame.

The light source part 500 provides light to the display panel 300. The light source part 500 is arranged, for instance, in a direct-illumination type or an edge-illumination type. The light source pad 500 of the edge-illumination type includes a light guide plate (LGP) disposed under the display panel 300 and at least one light source disposed at an edge portion of the LGP. The light source part 500 of the direct-illumination type includes at least one light source directly disposed under the display panel 300 and thus may of require a LGP.

The light source driving part 600 drives the light source part 500 according to the control of the timing control part 200. For example, the light source driving part 600 drives the light source part 500 in a global blinking mode. According to the global blinking mode, the light source part 500 generates light when the display panel 300 displays a left-eye image or a right-eye image corresponding to a left-eye data frame or a right-eye data frame, and blocks the light when the display panel 300 displays mixed images of a left-eye image and a right-eye image.

The glasses part 700 includes a left-eye shutter 710 and a right-eye shutter 730. The glasses part 700 selectively opens and closes the left-eye and right-eye shutters 710 and 730 during the third period T3 according to the control of the timing control part 200. For example, the glasses part 700 opens the left-eye shutter 710 and closes the right-eye shutter 730 during a period where the display panel 300 displays a left-eye image. The glasses part 700 opens the right-eye shutter 730 and closes the left-eye shutter 710 during a period where the display panel 300 displays a right-eye image.

Figure 2:
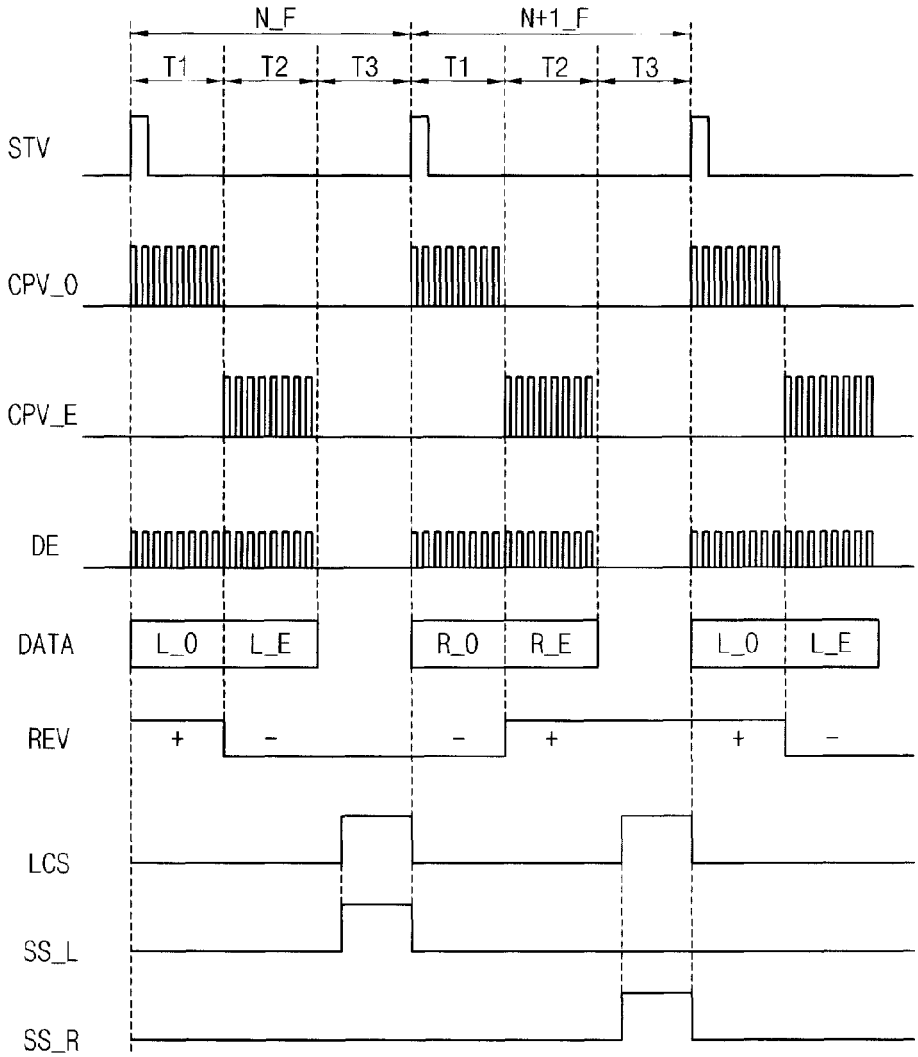
FIG. 2 is a waveform diagram illustrating driving signals for driving the display apparatus of FIG. 1.

FIG. 2 is a waveform diagram illustrating driving signals of driving the display apparatus of FIG. 1.

Referring to FIGS. 1 and 2, the timing control part 200 outputs a control signal which includes a vertical synchronizing signal STV, an odd clock signal CPV_O, an even clock signal CPV_E, a data enable signal DE, a reverse control signal REV, a light source control signal LCS, a left-eye shutter signal SS_L, a right-eye shutter signal SS_R, etc. The timing control part 200 outputs image data DATA.

The vertical synchronizing signal STV is a signal to distinguish each frame. For example, an N-th frame N_F and an (N+1)-th frame N+1_F may be distinguished from each other by the vertical synchronizing signal STV (N is a natural number).

The odd clock signal CPV_O is a control signal to generate an odd gate signal provided to the odd-numbered gate line. The odd clock signal CPV_O is activated during the first period T1 of the frame.

The even clock signal CPV_E is a control signal to generate an even gate signal provided to the even-numbered gate line. The even clock signal CPV_E is activated during the second period T2 of the frame.

The data enable signal DE is a signal to control the operation of the data driving part 430. The data enable signal DE is activated during the first and second periods T1 and T2 of the frame and inactivated during the third period T3 of the frame. During the third period T3, the odd and even clock signals CPV_O and CPV_E may be inactivated.

The image data DATA is provided to the data driving part 430 based on the data enable signal DE. The timing control part 200 outputs the odd-numbered data of data for the frame that correspond to the odd-numbered horizontal lines during the first period T1, and the even-numbered data of the data for the frame that correspond to the even-numbered horizontal lines during the second period T2.

For example, left-eye odd data L_O of the left-eye data frame is outputted during the first period T1 of the N-th frame N_F during which the odd clock signal CPV_O is activated, and left-eye even data L_E of the left-eye data frame is outputted during the second period T2 of the N-th frame N_F during which the even clock signal CPV_E is activated. Right-eye odd data R_O of the right-eye data frame is outputted during the first period T1 of the (N+1)-th frame N+1_F during which the odd clock signal CPV_O is activated, and right-eye even data R_E of the right-eye data frame is outputted during the second period T2 of the (N+1)-th frame N+1_F during which the even clock signal CPV_E is activated.

The reverse control signal REV controls the polarity of the data voltages provided to the display panel 300. In accordance with one exemplary embodiment, the reverse control signal REV is a control signal corresponding to a dot inversion mode which reverses the polarity of the data voltages on alternate pixels. In this instance, the phase of the reverse control signal REV in the first period T1 is opposite to the phase of the reverse control signal REV in the second period T2, and the phase of the reverse control signal REV in the third period T3 is substantially the same as the phase of the reverse control signal REV in the second period T2.

For example, when the reverse control signal REV is at a high level, the data voltage may have the positive polarity with respect to a reference voltage, and when the reverse control signal REV is at a low level, the data voltage may have the negative polarity with respect to the reference voltage.

In one exemplary embodiment, the reverse control signal REV has the high level during the first period T1 of the N-th frame N_F, and has the low level during the second and third periods T2 and T3 of the N-th frame N_F. Further, the reverse control signal REV may have the low level during the first period T1 of the (N+1)-th frame N+1_F and the high level during the second and third periods T2 and T3 of the (N+1)-th frame N+1_F. As shown in FIG. 2, the phase of the reverse control signal REV may be reversed with a one-frame period.

Therefore, a data voltage of the positive polarity corresponding to the left-eye odd data L_O may be provided to the display panel 300 during the first period T1 of the N-th frame N_F, and a data voltage of the negative polarity corresponding to the left-eye even data L_E may be provided to the display panel 300 during the second period T2 of the N-th frame N_F. In addition, a data voltage of the negative polarity corresponding to the right-eye odd data R_O may be provided to the display panel 300 during the first period T1 of the (N+1)- th frame N+1_F, and a data voltage of the positive polarity corresponding to the right-eye even data R_E may be provided to the display panel 300 during the second period T2 of the (N+1)-th frame N+1_F.

The light source control signal LCS is provided to the light source driving part 600 in order to control the operation of the light source part 500. The light source control signal LSC controls the light source part 500 to emit light based on a liquid crystal ("LC") response time, after the data voltages of the left-eye or right-eye data frame are provided to the display panel 300. For example, the light source control signal LCS has a low level during the first and second periods T1 and T2 where the data voltages are provided to the display panel 300 so that the light source part 500 does not emit light. The light source control signal LCS has a high level during the third period T3 where the data voltages are stopped from being provided to the display panel 300, so that the light source part 500 emits light.

In the present exemplary embodiment, the light source control signal LCS has a high level during the third period T3, but is not limited thereto. The duration where the level of the light source control signal LCS is maintained high may be variously adjusted in the frame.

The left-eye shutter signal SS_L is a control signal to control the left-eye shutter 710 of the glasses part 700. The left-eye shutter signal SS_L has a high level during the third period T3 of the N-th frame N_F where the display panel 300 displays a left-eye image based on a LC response time, so that the left-eye shutter 710 is opened. The left-eye shutter signal SS_L may have a two-frame period.

In the present exemplary embodiment, the left-eye shutter signal SS_L has the high level during the third period T3, but is not limited thereto. The duration where the level of the left-eye shutter signal SS_L is maintained high may be variously adjusted in the two frames.

The right-eye shutter signal SS_R is a control signal to control the right-eye shutter 730 of the glasses part 700. The right-eye shutter signal SS_R has a high level during the third period T3 of the (N+1)-th frame N+1_F where the display panel 300 displays a right-eye image based on the LC response time, so that the right-eye shutter 730 is opened. The right-eye shutter signal SS_R may be delayed for one frame from the left-eye shutter signal SS_L and may have a two-frame period.

In the present exemplary embodiment, the right-eye shutter signal SS_R has the high level during the third period T3, but is not limited thereto. The duration where the level of the right-eye shutter signal SS_R is maintained high may be variously adjusted in the two frames.

Figure 3:
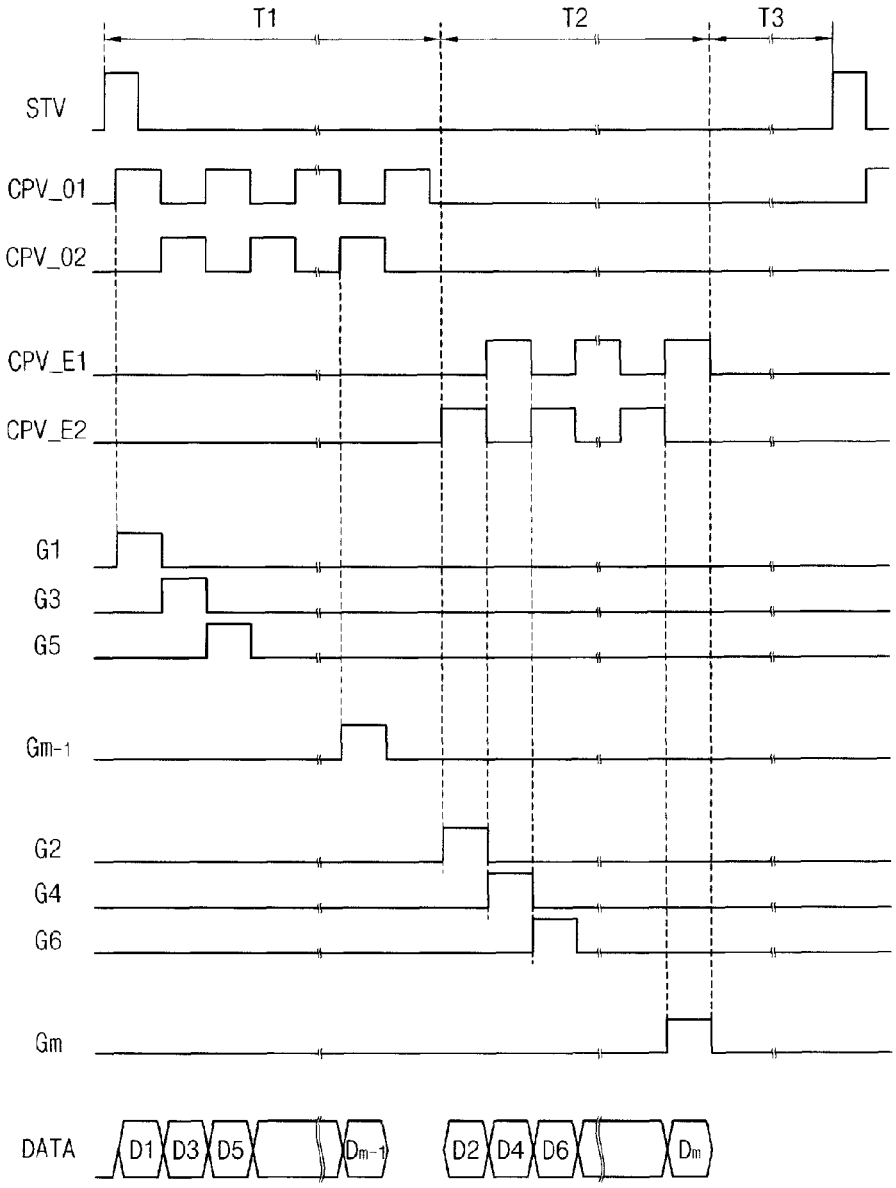
FIG. 3 is a waveform diagram illustrating a method of driving a display panel according to another exemplary embodiment of the present invention.
Figure 4:
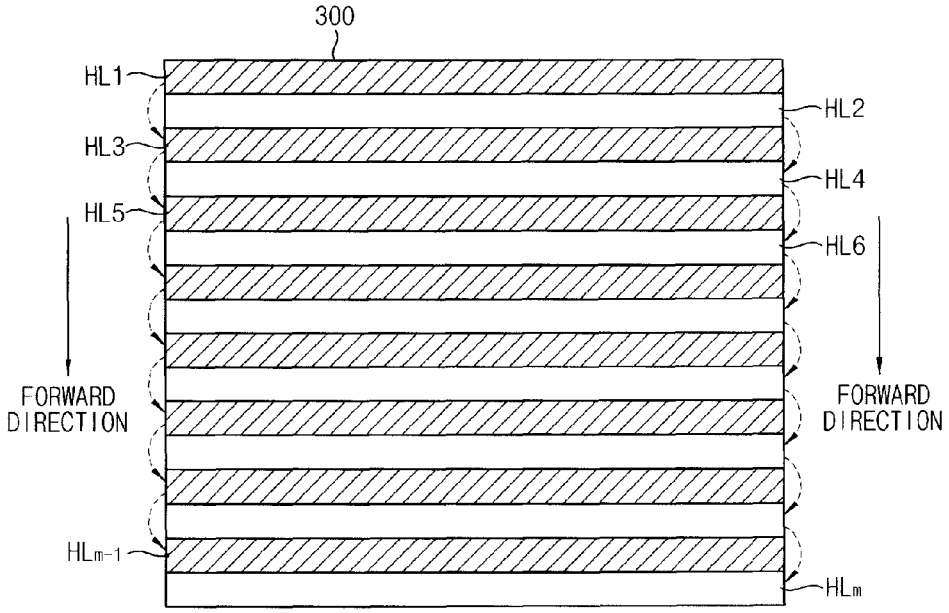
FIG. 4 is a schematic diagram illustrating an operation of the display panel according to the method of FIG. 3.

FIG. 3 is a waveform diagram illustrating a method of driving a display panel according to another exemplary embodiment of the present invention. FIG. 4 is a schematic diagram illustrating an operation of the display panel according to the method of FIG. 3.

Referring to FIGS. 3 and 4, the gate driving part 410 generates odd gate signals G1, G3, G5, . . . , Gm-1 and even gate signals G2, G4, G6, . . . , Gm based on a vertical synchronizing signal STV, a first odd clock signal CPV_O1, a second odd clock signal CPV_O2, a first even clock signal CPV_E1, and a second even clock signal CPV_E2.

When the gate driving part 410 is mounted on the display panel 300 such as in the type of a chip, the gate driving part 410 may receive the vertical synchronizing signal STV, the first odd clock signal CPV_O1, the second odd clock signal CPV_O2, the first even clock signal CPV_E1, and the second even clock signal CPV_E2. When the gate driving part 410 may be formed on the display panel 300 via substantially the same process as that for forming the switching element TR, the display apparatus may further include a gate driving signal generating circuit. The gate driving signal generating circuit receives the vertical synchronizing signal STV, the first odd clock signal CPV_O1, the second odd clock signal CPV_O2, the first even clock signal CPV_E1, and the second even clock signal CPV_E2 to generate a starting vertical signal in synchronization with the vertical synchronizing signal STV, first and second clock signals in synchronization with the first and second odd clock signals CPV_O1 and CPV_O2, and third and fourth clock signals in synchronization with the first and second even clock signals CPV_E1 and CPV_E2. The gate driving part 410 may receive the signals generated at the gate driving signal generating circuit.

The gate driving part 410 generates the odd gate signals G1, G3, G5, . . . , Gm-1 based on the first odd clock signal CPV_O1 and the second odd clock signal CPV_O2, which is delayed from the first odd clock signal CPV_O1, during the first period T1 of the frame, and sequentially outputs the odd gate signals G1, G3, G5, . . . , Gm-1 along a forward direction. Then, the gate driving part 410 generates the even gate signals G2, G4, G6, . . . , Gm based on the first even clock signal CPV_E1 and the second even clock signal CPV_E2, which is delayed from the first even clock signal CPV_E1, during the second period T2 of the frame, and sequentially outputs the even gate signals G2, G4, G6, . . . , Gm along the forward direction.

The data driving part 430 outputs data voltages for horizontal lines in synchronization with the gate driving part 410. For example, during the first period T1, the data driving part 430 outputs data voltages D1 for a first horizontal line HL1 during a horizontal period where a first gate signal G1 is outputted to a first gate line corresponding to the first horizontal line HL1, data voltages D3 for a third horizontal line HL3 during a horizontal period where a third gate signal G3 is outputted to a third gate line corresponding to the third horizontal line HL3, and data voltages D5 for a fifth horizontal line HL5 during a horizontal period where a fifth gate signal G5 is outputted to a fifth gate line corresponding to the fifth horizontal line HL5. Likewise, the data driving part 430 finally outputs data voltages Dm-1 for an (m−1)-th horizontal line HLm-1. In this manner, the display panel 300 sequentially displays an odd line image along the forward direction.

Further, during the second period T2, the data driving part 430 outputs data voltages D2 for a second horizontal line HL2 during a horizontal period where a second gate signal G2 is outputted to a second gate line corresponding to the second horizontal line HL2, data voltages D4 for a fourth horizontal line HL4 during a horizontal period where a fourth gate signal G4 is outputted to a fourth gate line corresponding to the fourth horizontal line HL4, and data voltages D6 for a sixth horizontal line HL6 during a horizontal period where a sixth gate signal G6 is outputted to a sixth gate line corresponding to the sixth horizontal line HL6. Likewise, the data driving part 430 outputs data voltages Dm for an m-th horizontal line HLm. In this manner, the display panel 300 sequentially displays an even line image along the forward direction.

In the present exemplary embodiment, the display panel 300 sequentially displays the partial odd-line image of the entire left-eye or right-eye image along the forward direction and sequentially displays the partial even-line image of the entire left-eye or right-eye image along the forward direction.

Generally, when a display panel is operated in a progressive scan mode for progressing from the upper area toward the lower area of the display panel, crosstalk between the left-eye and right-eye images may be observed more intensively at the lower area than at the upper area.

However, according to the present exemplary embodiment, after the partial odd-line image is sequentially displayed on the display panel, the partial even-line image is sequentially displayed on the display panel. Thus, the even-line image is displayed being spread across the display panel during the latter part of the frame, so that the crosstalk of the 3D images is prevented from being recognized by the viewer. Therefore, the display quality of the 3D images may be improved.

Figure 5:
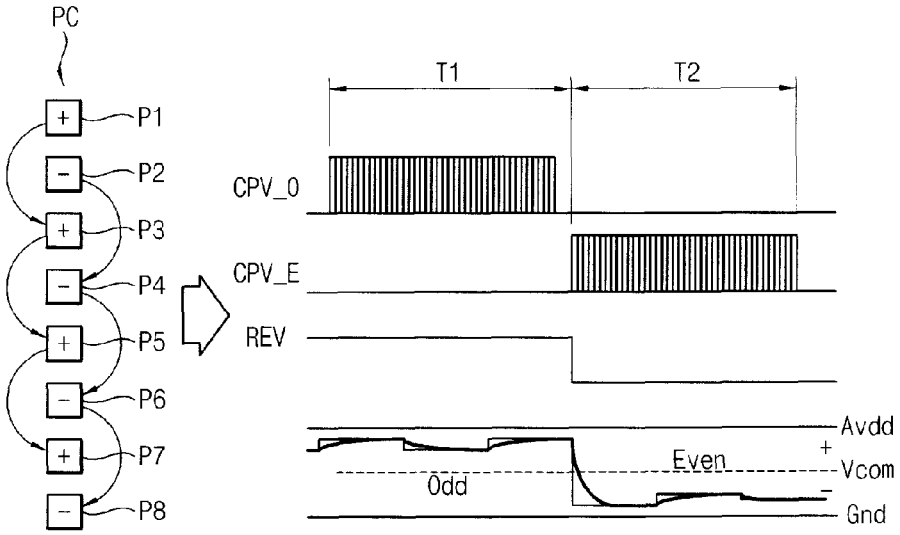
FIG. 5 is a waveform diagram illustrating a charging rate of a data voltage according to the driving signals of FIG. 2.

FIG. 5 is a waveform diagram illustrating a charging rate of a data voltage according to the driving signals of FIG. 2.

Referring to FIGS. 2 and 5, according to one exemplary embodiment, pixels P1, P2, . . . , P8 of the pixel column PC receive the data voltages of the polarity corresponding to the dot inversion mode. According to the dot inversion mode, the polarity of the data voltage provided to the first pixel is different from the polarity of the data voltage provided the second pixel adjacent to the first pixel.

Hereinafter, the polarity of the data voltages provided to the first to eighth pixels P1, P2, . . . , P8 included in the pixel column PC based on the reverse control signal REV is described in more detail.

In accordance with one embodiment of the present invention, the reverse control signal REV may have the high level during the first period T1 of the frame, and may have the low level during the second period T2 of the frame. The data driving part 430 outputs the data voltages for the odd-numbered horizontal lines during the first period T1 and outputs the data voltages for the even-numbered horizontal lines during the second period T2.

In this instance, the data driving part 430 outputs the data voltages of the positive polarity (+) with respect to the reference voltage Vcom based on the high level of the reverse control signal REV to each of the first pixel P1, the third pixel P3, the fifth pixel P5, and the seventh pixel P7 during the first period T1. Each of the first pixel P1, the third pixel P3, the fifth pixel P5, and the seventh pixel P7 receives the data voltages of the same positive polarity (+) during the first period T1, so that each of the first pixel P1, the third pixel P3, the fifth pixel P5, and the seventh pixel P7 may have improved charging rates of the data voltages.

In addition, the data driving part 430 outputs the data voltages of the negative polarity (−) with respect to the reference voltage Vcom based on the low level of the reverse control signal REV to each of the second pixel P2, the fourth pixel P4, the sixth pixel P6, and the eighth pixel P8 during the second period T2. Each of the second pixel P2, the fourth pixel P4, the sixth pixel P6, and the eighth pixel P8 receives the data voltages of the same negative polarity (−) during the second period T2, so that each of the second pixel P2, the fourth pixel P4, the sixth pixel P6, and the eighth pixel P8 may have improved charging rates of the data voltages. As described above, data voltages having the polarities according to the dot inversion mode are applied to the first to eighth pixels P1, P2, . . . , P8 included in the pixel column PC.

According to the present exemplary embodiment, the phase of the reverse control signal REV may be reversed with a one-frame period.

Generally, the reverse control signal according to the dot inversion mode in which the polarity of data voltages is reversed on alternate dots (or alternate pixels), has phases to be reversed with a period of one round of scanning. The reverse control signal according to the column inversion mode in which the polarity of data voltages is reversed on alternate pixel columns, has the phases to be reversed with a period of one frame. However, according to the present exemplary embodiment, the display panel 300 is divided into an odd-numbered part including the odd-numbered horizontal lines and an even-numbered part including the even-numbered horizontal lines, and the odd-numbered and even-numbered parts are sequentially driven, so that the polarities of the data voltages according to the dot inversion mode can be obtained using the reverse control signals according to the column reverse mode.

Therefore, the driving frequency of the reverse control signal REV can be reduced, and thus the power consumption for generating the reverse control signals can also be reduced. In addition, the polarities of the data voltages applied to the data lines remain unchanged during the first period T1 or the second period T2, and thus the charging rates of the pixels connected to the data lines can be improved.

Figure 6:
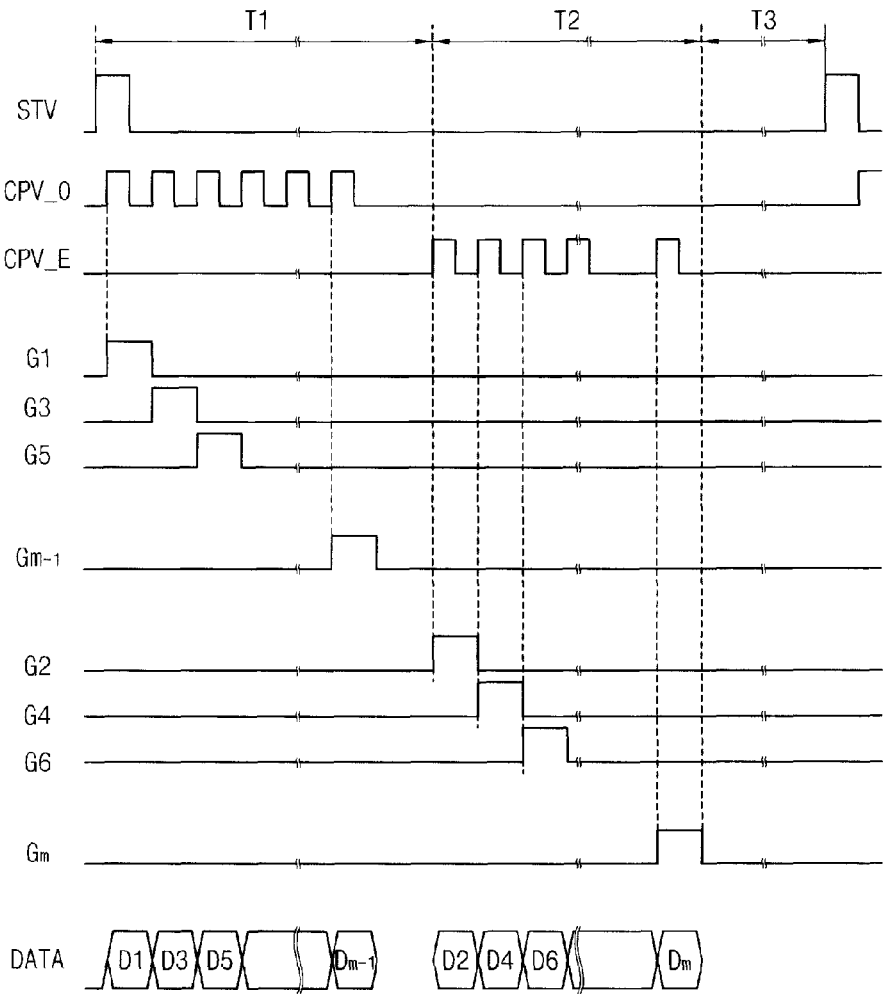
FIG. 6 is a waveform diagram illustrating a method of driving a display panel according to still another exemplary embodiment of the present invention.

FIG. 6 is a waveform diagram illustrating a method of driving a display panel according to still another exemplary embodiment of the present invention. Hereinafter, the same reference numerals are used to refer to the same or like parts as those described in the previous exemplary embodiments, and the same detailed explanations are not repeated unless necessary.

Referring to FIGS. 1 and 6, a gate driving part 410 according to the present exemplary embodiment has a single structure and may be a driving chip which is mounted in a peripheral area of the display panel 300.

The gate driving part 410 generates odd gate signals G1, G3, G5, . . . , Gm-1 and even gate signals G2, G4, G6, . . . , Gm based on the vertical synchronizing signal STV, the odd clock signal CPV_O, and the even clock signal CPV_E.

During the first period T1, the gate driving part 410 generates the odd gate signals G1, G3, G5, . . . , Gm-1 based on the odd clock signal CPV_O and sequentially outputs the odd gate signals G1, G3, G5, . . . , Gm-1 along a forward direction.

The data driving part 430 sequentially outputs data voltages D1, D3, . . . , Dm-1 for the odd horizontal lines HL1, HL3, . . . , HLm-1 in synchronization with the odd gate signals G1, G3, G5, . . . , Gm-1 during the first period T1. Thus, an odd line image is displayed along the forward direction on the display panel 300.

During the second period T2, the gate driving part 410 generates the even gate signals G2, G4, G6, . . . , Gm based on the even clock signal CPV_E and sequentially outputs the even gate signals G2, G4, G6, . . . , Gm along the forward direction.

The data driving part 430 sequentially outputs data voltages D2, D4, . . . , Dm of the even horizontal lines HL2, HL4, . . . , HLm in synchronization with the even gate signals G2, G4, G6, . . . , Gm during the second period T2, respectively. Thus, an even line image is displayed along the forward direction on the display panel 300.

Figure 7:
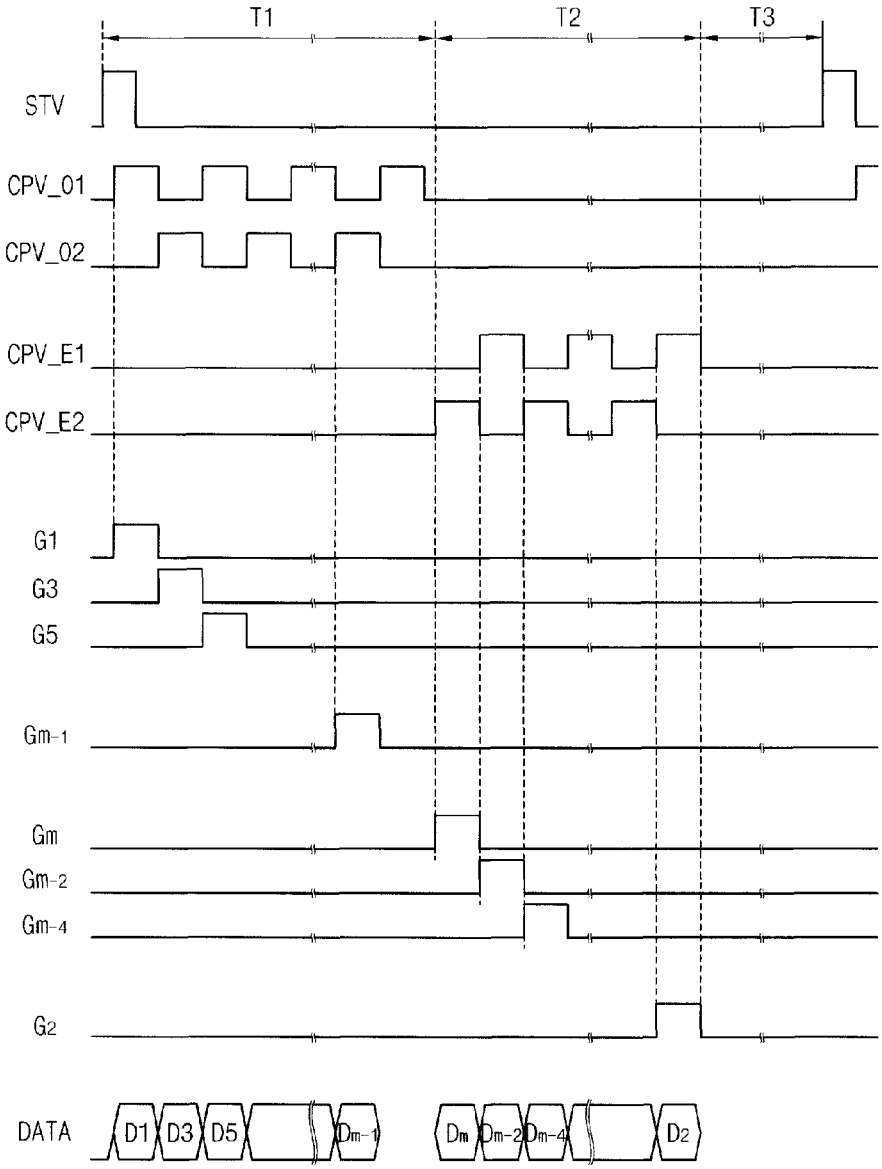
FIG. 7 is a waveform diagram illustrating a method of driving a display panel according to still another exemplary embodiment of the present invention.
Figure 8:
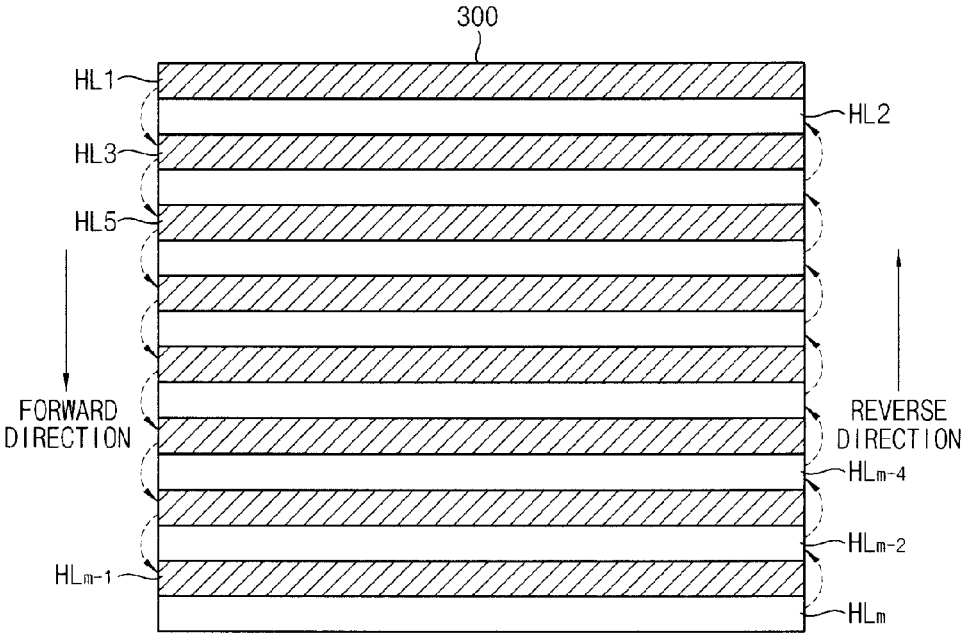
FIG. 8 is a schematic diagram illustrating an operation of the display panel according to the method of FIG. 7.

FIG. 7 is a waveform diagram illustrating a method of driving a display panel according to still another exemplary embodiment of the present invention. FIG. 8 is a schematic diagram illustrating an operation of the display panel according to the method of FIG. 7.

Referring to FIGS. 7 and 8, during the first period T1, the gate driving part 410 generates the odd gate signals G1, G3, G5, . . . , Gm-1 based on the second odd clock signal CPV_O2 delayed from the first odd clock signal CPV_O1 and the first odd clock signal CPV_O1, and sequentially outputs the odd gate signals G1, G3, G5, . . . , Gm-1 along the forward direction. During the second period T2, the gate driving part 410 generates based on the second even clock signal CPV_E2 delayed from the first even clock signal CPV_E1 and the first even clock signal CPV_E, and sequentially outputs the even gate signals Gm, Gm-2, Gm-4, . . . , G2 along a reverse direction opposite to the forward direction.

The data driving part 430 outputs data voltages for the horizontal lines unit in synchronization with the gate driving part 410. For example, during the first period T1, the data driving part 430 outputs data voltages D1 for a first horizontal line HL1 during a horizontal period where a first gate signal G1 is outputted to a first gate line corresponding to the first horizontal line HL1, data voltages D3 for a third horizontal line HL3 during a horizontal period where a third gate signal G3 is outputted to a third gate line corresponding to the third horizontal line HL3, and data voltages D5 for a fifth horizontal line HL5 during a horizontal period where a fifth gate signal G5 is outputted to a fifth gate line corresponding to the fifth horizontal line HL5. Likewise, the data driving part 430 finally outputs data voltages Dm-1 for an (m−1)-th horizontal line HLm-1. In this manner, the display panel 300 sequentially displays an odd line image along the forward direction.

Then, during the second period T2, the data driving part 430 outputs data voltages Dm for an m-th horizontal line HLm during a horizontal period where an m-th gate signal Gm is outputted to an m-th gate line corresponding to the m-th horizontal line HLm, data voltages Dm-2 of an (m−2)-th horizontal line HLm-2 during a horizontal period where an (m−2)-th gate signal Gm-2 is outputted to an (m−2)-th gate line corresponding to the (m−2)-th horizontal line HLm-2, and data voltages Dm-4 for an (m−4)-th horizontal line HLm-4 during a horizontal period where an (m−4)-th gate signal Gm-4 is outputted to an (m−4)-th gate line corresponding to the (m−4)-th horizontal line HLm-4. Likewise, the data driving part 430 outputs data voltages D2 for a second horizontal line HL2. In this manner, the display panel 300 sequentially displays an even line image along the reverse direction.

In the present exemplary embodiment, the display panel 300 sequentially displays the partial odd line image of the entire left-eye or right-eye image along the forward direction and sequentially displays the partial even line image of the entire left-eye or right-eye image along the reverse direction.

Generally, when a display panel is driven in the progressive scan mode for progressing from the upper area toward the lower area of the display panel, crosstalk between the left-eye and right-eye images tends to be observed at the lower area more intensively than at the upper area.

However, according to the present exemplary embodiment, after the odd line image is sequentially displayed on the display panel, the even line image is sequentially displayed on the display panel. Thus, the even line image is displayed being spread across the display panel during the latter part of the frame, so that the crosstalk of the 3D image is prevented from being recognized by the viewer. Therefore, the display quality of the 3D image can be improved.

Figure 9:
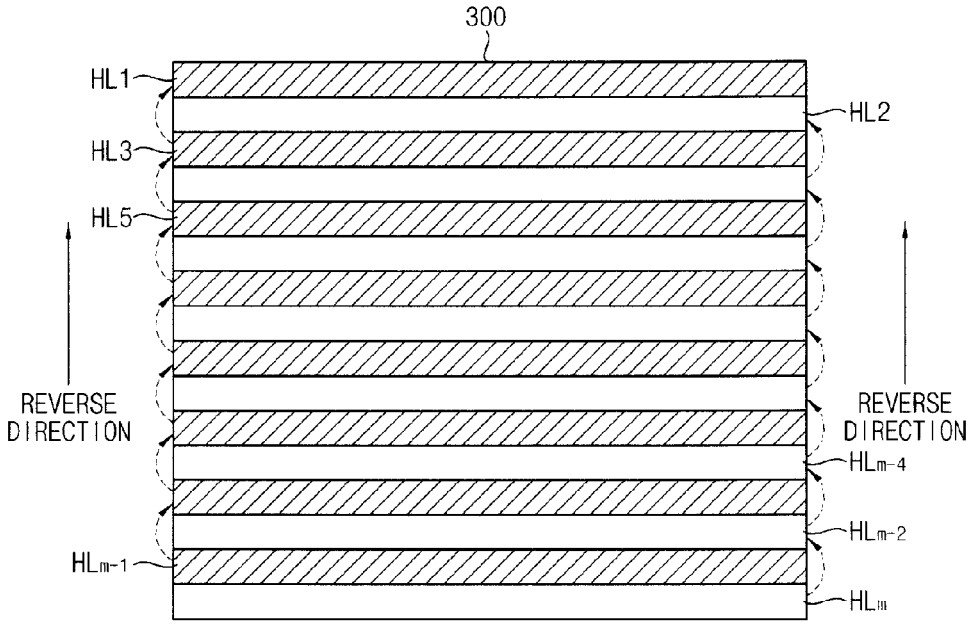
FIG. 9 is a schematic diagram illustrating a method of driving a display panel according to still another exemplary embodiment of the present invention.

FIG. 9 is a schematic diagram illustrating a method of driving a display panel according to still another exemplary embodiment of the present invention.

When compared with the method of the previous exemplary embodiment shown in FIG. 4, the scan directions for scanning on the display panel during the first and second periods T1 and T2 are different from each other.

For example, referring to FIGS. 6 and 9, during the first period T1 of the frame, the gate driving part 410 generates the odd gate signals Gm-1, . . . , G5, G3, G1 based on the odd clock signal CPV_O, and sequentially outputs the odd gate signals Gm-1, . . . , G5, G3, G1 along the reverse direction.

The data driving part 430 sequentially outputs the data voltages Dm-1, . . . , D5, D3, D1 of the odd horizontal lines HLm-1, . . . , HL5, HL3, HL1 in synchronization with the odd gate signals Gm-1, . . . , G5, G3, G1 outputted along the reverse direction. Therefore, the display panel 300 sequentially displays the odd line image along the reverse direction.

During the second period T2 of the frame, the gate driving part 410 generates the even gate signals Gm, . . . , G6, G4, G2 based on the even clock signal CPV_E, and sequentially outputs the even gate signals Gm, . . . , G6, G4, G2 along the reverse direction.

The data driving part 430 sequentially outputs the data voltages Dm, . . . , D6, D4, D2 of the even horizontal lines HLm, . . . , HL6, HL4, HL2 in synchronization with the even gate signals Gm, . . . , G6, G4, G2 outputted along the reverse direction. Therefore, the display panel 300 sequentially displays the even line image along the reverse direction.

In the present exemplary embodiment, the display panel 300 sequentially displays the partial odd line image of the entire left-eye or right-eye image along the reverse direction and sequentially displays the partial even line image of the entire left-eye or right-eye image along the reverse direction. Thus, the even line image is displayed being spread across the display panel during the latter part of the frame, so that the crosstalk of the 3D image is prevented from being recognized by the viewer. Therefore, the display quality of the 3D image can be improved.

Figure 10:
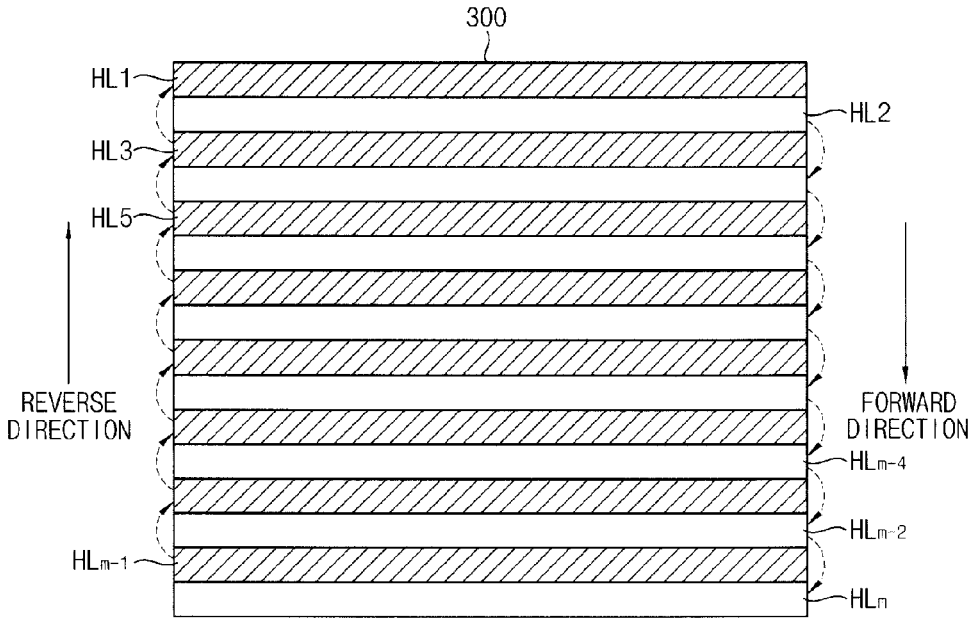
FIG. 10 is a schematic diagram illustrating a method of driving a display panel according to still another exemplary embodiment of the present invention.

FIG. 10 is a schematic diagram illustrating a method of driving a display panel according to still another exemplary embodiment of the present invention.

When compared with the method according to the previous exemplary embodiment shown in FIG. 8, the scan directions for scanning on the display panel during the first and second periods T1 and T2 are different from each other.

For example, referring to FIGS. 6 and 10, during the first period T1 of the frame, the gate driving part 410 generates the odd gate signals Gm-1, . . . , G5, G3, G1 based on the odd clock signal CPV_O, and sequentially outputs the odd gate signals Gm-1, . . . , G5, G3, G1 along the reverse direction.

The data driving part 430 sequentially outputs the data voltages Dm-1, . . . , D5, D3, D1 for the odd horizontal lines HLm-1, . . . , HL5, HL3, HL1 in synchronization with the odd gate signals Gm-1, . . . , G5, G3, G1 outputted along the reverse direction. Therefore, the display panel 300 sequentially displays the odd line image along the reverse direction.

During the second period T2 of the frame, the gate driving part 410 generates the even gate signals G2, G4, G6, . . . , Gm based on the even clock signal CPV_E, and sequentially outputs the even gate signals G2, G4, G6, . . . , Gm along the forward direction.

The data driving part 430 sequentially outputs the data voltages D2, D4, D6, . . . , Dm of the even horizontal lines HL2, HL4, HL6, . . . , HLm in synchronization with the even gate signals G2, G4, G6, . . . , Gm outputted along the forward direction. Therefore, the display panel 300 sequentially displays the even line image along the forward direction.

In the present exemplary embodiment, the display panel 300 sequentially displays the partial odd line image of the entire left-eye or right-eye image along the reverse direction and sequentially displays the partial even line image of the entire left-eye or right-eye image along the forward direction. Thus, the even line image is displayed being spread across the display panel during the latter part of the frame, so that the crosstalk of the 3D image is prevented from being recognized by the viewer. Therefore, the display quality of the 3D image can be improved.

Figure 11:
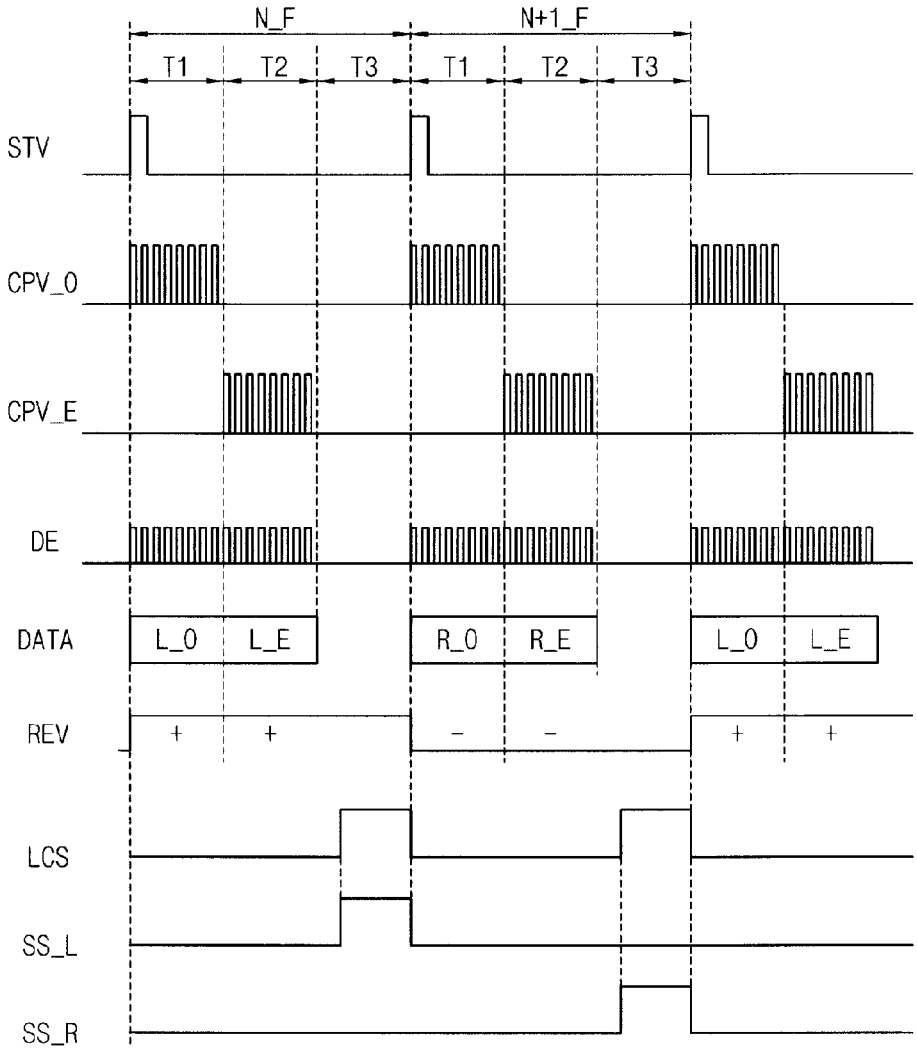
FIG. 11 is a waveform diagram illustrating driving signals of a display apparatus according to still another exemplary embodiment of the present invention.

FIG. 11 is a waveform diagram illustrating driving signals of a display apparatus according to still another exemplary embodiment of the present invention.

Referring to FIGS. 2 and 11, when compared with the driving signals according to the previous exemplary embodiment shown in FIG. 2, the driving signals according to the present exemplary embodiment are substantially the same except for a reverse control signal REVc. The reverse control signal REV shown in FIG. 2 is a control signal corresponding to the one dot inversion mode, and the reverse control signal REVc according to the present exemplary embodiment is a control signal corresponding to the column reverse mode. Hereinafter, the same reference numerals are used to refer to the same or like parts as those described in the previous exemplary embodiment, and the same detailed explanations are not repeated unless necessary.

The reverse control signal REVc has the same phase during the first, second, and third periods T1, T2, and T3 of the frame. For example, the reverse control signal REVc has the high level during the first, second, and third periods T1, T2, and T3 of an N-th frame N_F and the low level during the first, second, and third periods T1, T2, and T3 of an (N+1)-th frame N+1_F. As shown in the FIG. 11, the reverse control signal REVc may have the phases reversed on alternate frames.

Based on the reverse control signal REVc, the display panel 300 receives the data voltages of the positive polarity corresponding to the left-eye odd data L_O and the left-eye even data L_E during the first and second periods T1 and T2 of the N-th frame N_F, and receives the data voltages of the negative polarity corresponding to the right-eye odd data R_O and the right-eye even data R_E during the first and second periods T1 and T2 of the (N+1)-th frame N+1_F. Thus, the display panel 300 may receive the data voltages of the polarities corresponding to the column reverse mode.

According to one exemplary embodiment, the display panel 300 may sequentially display the odd (or even) line image of the left-eye or right-eye image along the reverse direction and also may sequentially display the even (or odd) line image of the left-eye or right-eye image along the reverse direction. Thus, the even (or odd) line image is displayed being spread across the display panel during the latter part of the frame, so that the crosstalk of the 3D image is prevented from being recognized by the viewer. Therefore, the display quality of the 3D image can be improved.

In addition, the reverse control signal REVc of the column reverse mode has a two-frame period. Thus, the power consumption can be reduced, and the charging rates of the data voltages can be improved.

Figure 12:
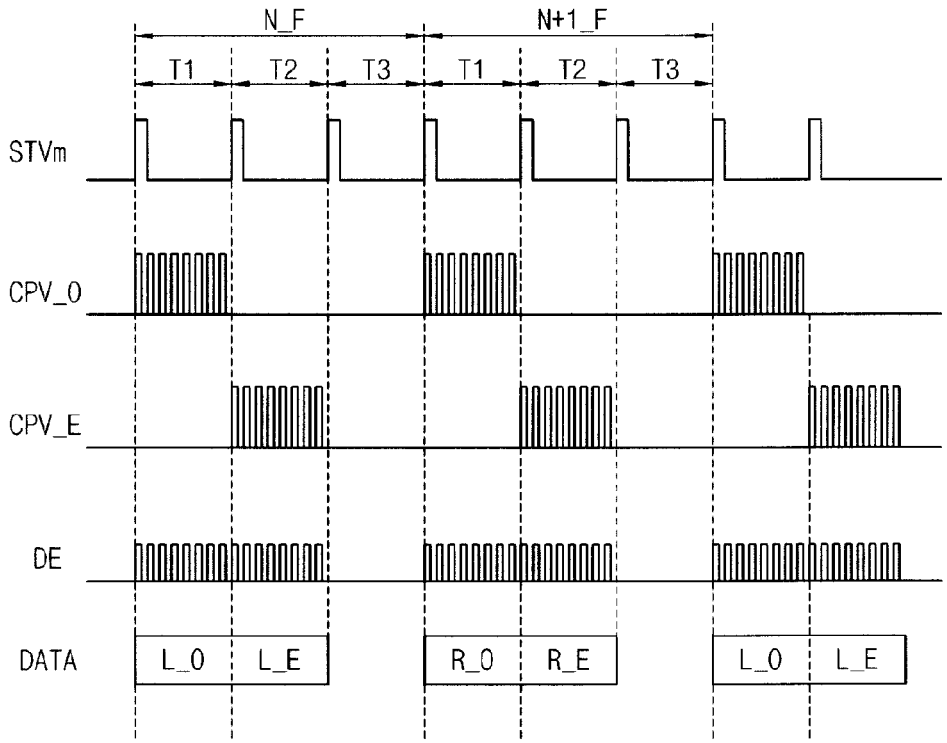
FIG. 12 is a waveform diagram illustrating driving signals of a display apparatus according to still another exemplary embodiment of the present invention.

FIG. 12 is a waveform diagram illustrating driving signals of a display apparatus according to still another exemplary embodiment of the present invention.

Hereinafter, the same reference numerals are used to refer to the same or like parts as those described in the previous exemplary embodiments, and the same detailed explanations are not repeated unless necessary.

Referring to FIGS. 1 and 12, the 3D processing part 100 outputs the 3D image data including the left-eye data frame and the right-eye data frame to the timing control part 200 according to an interlace scan mode.

The 3D processing part 100 divides the left-eye data frame into first left-eye partial data and second left-eye partial data and sequentially outputs the first left-eye partial data and the second left-eye partial data. The 3D processing part 100 divides the right-eye data frame into first right-eye partial data and second right-eye partial data and sequentially outputs the first right-eye partial data and the second right-eye partial data. The first left-eye partial data may be referred to as the left-eye odd data, and the second left-eye partial data may be referred to as the left-eye even data. In addition, the first right-eye partial data may be referred to as the right-eye odd data, and the second right-eye partial data may be referred to as the right-eye even data.

The timing control part 200 receives the left-eye odd data during the first period T1 of the N-th frame N_F and the left-eye even data during the second period T2 of the N-th frame N_F, and does not receive any 3D image data during the third period T3 of the N-th frame N_F. The timing control part 200 receives the right-eye odd data during the first period T1 of the (N+1)-th frame N+1_F and the right-eye even data during the second period T2 of the (N+1)-th frame N+1_F, and does not receive any 3D image data during the third period T3 of the (N+1)-th frame N+1_F. The third period T3 may be a blanking period during which image data is not provided.

The timing control part 200 may generate a vertical synchronizing signal STVm having a driving frequency of, for instance, three times that of the vertical synchronizing signal STV shown in FIG. 2. The vertical synchronizing signal STVm of the present exemplary embodiment may divide the frame into the first period T1, the second period T2, and the third period T3.

The timing control part 200 outputs the left-eye odd data L_O to the data driving part 430 during the first period T1 of the N-th frame N_F where the odd clock signal CPV_O is activated, and outputs the left-eye even data L_E to the data driving part 430 during the second period T2 of the N-th frame N_F where the even clock signal CPV_E is activated. The timing control part 200 outputs the right-eye odd data R_O to the data driving part 430 during the first period T1 of the (N+1)-th frame N+1_F where the odd clock signal CPV_O is activated, and outputs the right-eye even data R_E to the data driving part 430 during the second period T2 of the (N+1)-th frame N+1_F where the even clock signal CPV_E is activated.

As mentioned above, the timing control part 200 may output the image data, which is received in the interlace scan mode, to the data driving part 430.

According to the present exemplary embodiment, the timing control part 200 receives the image data according to the interlace scan mode, so that the timing control part 200 may not require a memory for storing the received image data, when compared with the previous exemplary embodiments.

According to the present exemplary embodiment, the reverse control signal REV, the light source control signal LCS, the left-eye shutter signal SS_L, and the right-eye shutter signal SS_R may be substantially the same as those of the previous exemplary embodiment shown in FIG. 2, or may be substantially the same as those of the previous exemplary embodiment shown in FIG. 10. Thus, detailed descriptions as to the same signals are not repeated.

While this invention has been described in connection with exemplary embodiments, it is to be understood that the invention is not limited to the exemplary embodiments. It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A method of driving a display panel of a liquid crystal display (LCD), the method comprising:

outputting first data voltages representing, by a panel driver, a left-eye image or a right-eye image to first horizontal lines among a plurality of horizontal lines of the display panel of the LCD during a first period of a frame for rendering the left-eye image or the right-eye image of a three-dimensional (3D) image;

outputting second data voltages representing, by the panel driver, the same left-eye image or the right-eye image to second horizontal lines among the plurality of horizontal lines of the display panel of the LCD during a second period of the frame for rendering the left-eye image or right-eye image of the 3D image; and stopping data voltages from being outputted to the display panel of the LCD during a third period of the frame, wherein the first horizontal lines are odd-numbered horizontal lines and the second horizontal lines are even-numbered horizontal lines.

2. The method of claim 1, further comprising:

sequentially outputting a plurality of first gate signals to a plurality of gate lines corresponding to the first horizontal lines along a first direction during the first period; and sequentially outputting a plurality of second gate signals to a plurality of gate lines corresponding to the second horizontal lines along the first direction during the second period.

3. The method of claim 1, further comprising:

sequentially outputting a plurality of first gate signals to a plurality of gate lines corresponding to the first horizontal lines along a first direction during the first period; and sequentially outputting a plurality of second gate signals to a plurality of gate lines corresponding to the second horizontal lines along a second direction opposite to the first direction during the second period.

4. The method of claim 1, further comprising:

generating a reverse control signal for controlling a polarity of data voltages, wherein the reverse control signal has a phase to be reversed with a one-frame period.

5. The method of claim 4, wherein the phase of the reverse control signal in the first period is opposite to the phase of the reverse control signal in the second period, and the phase of the reverse control signal in the third period is substantially the same as the phase of the reverse control signal in the second period.

6. The method of claim 4, wherein the phase of the reverse control signal is substantially the same in the first, second, and third periods.

7. A liquid crystal display (LCD) apparatus, comprising:

a display panel of the LCD comprising a plurality of horizontal lines;

a timing control part comprising non-transitory computer readable medium having stored thereon one or more instructions; and a data driver configured to execute the instructions stored on the non-transitory computer readable medium by:

representing a left-eye image or a right-eye image to first horizontal lines among the plurality of horizontal lines of the display panel of the LCD during a first period of a frame for rendering the left-eye image or the right-eye image of a 3D image, representing the same left-eye image or the right-eye image to second horizontal lines among the plurality of signal lines of the display panel of the LCD during a second period of the frame, and stopping data voltages from being outputted to the display panel of the LCD during a third period of the frame, wherein the first horizontal lines interleave the second horizontal lines, wherein the first horizontal lines are odd-numbered horizontal lines and the second horizontal lines are even-numbered horizontal lines.

8. The LCD apparatus of claim 7, wherein the timing control part is configured to generate at least one first clock signal to be activated during the first period and inactivated during the second period, and at least one second clock signal to be activated during the second period and inactivated during the first period.

9. The LCD apparatus of claim 8, further comprising:

a gate driver configured to generate a first gate signal to provide to the first horizontal lines based on the at least one first clock signal and configured to generate a second gate signal to provide to the second horizontal lines based on the at least one second clock signal.

10. The LCD apparatus of claim 9, wherein the gate driver has a single structure and is disposed adjacent to an end portion of a gate line included in the display panel of the LCD.

11. The LCD apparatus of claim 9, wherein the gate driver has a dual structure and is disposed adjacent to each of end portions of a gate line included in the display panel of the LCD, the gate driver comprising:

a first gate driver positioned adjacent to a first end portion of the gate line and configured to generate the first gate signal; and a second gate driver positioned adjacent to a second end portion of the gate line and configured to generate the second gate signal.

12. The LCD apparatus of claim 9, wherein the gate driver is configured to sequentially output a plurality of first gate signals to a plurality of gate lines corresponding to the first horizontal lines along a first direction during the first period, and is configured to sequentially output a plurality of second gate signals to a plurality of gate lines corresponding to the second signal lines along the first direction during the second period.

13. The LCD apparatus of claim 9, wherein the gate driver is configured to sequentially output a plurality of first gate signals to a plurality of gate lines corresponding to the first horizontal lines along a first direction during the first period, and is configured to sequentially output a plurality of second gate signals to a plurality of gate lines corresponding to the second horizontal lines along a second direction opposite to the first direction during the second period.

14. The LCD apparatus of claim 8, wherein the timing control part is configured to generate a reverse control signal for controlling a polarity of data voltages with respect to a reference voltage, and the reverse control signal has a phase to be reversed with a one-frame period.

15. The LCD apparatus of claim 14, wherein the phase of the reverse control signal in the first period is opposite to the phase of the reverse control signal in the second period, and the phase of the reverse control signal in the third period is substantially the same as the phase of the reverse control signal in the second period.

16. The LCD apparatus of claim 14, wherein the phase of the reverse control signal is substantially the same in the first, second, and third periods.

17. The LCD apparatus of claim 8, further comprising:

a light source part configured to provide light to the display panel of the LCD during the third period based on a control signal of the timing control part.

18. The LCD apparatus of claim 8, further comprising:

a glasses part comprising a left-eye shutter and a right-eye shutter, wherein the glasses part is configured to selectively open and close the left-eye shutter and the right-eye shutter during the third period based on a control signal of the timing control part.

19. A method of driving a display panel of a liquid crystal display (LCD) comprising gate lines and data lines that define pixels, the method comprising:

providing, by a gate driver, first gate signals to a first group of gate lines in a first sub-frame of a first frame;

providing, by a data driver, first data signals for a first eye image of a 3D image through the data lines to pixels connected to the first group of gate lines in synchronization with the first gate signals;

providing, by the gate driver, second gate signals to the second group of gate lines in a second sub-frame of a second frame; and providing, by the data driver, second data signals for the first eye image through the data lines to pixels connected to the second group of gate lines in synchronization with the second gate signals, wherein the gate lines of the first group are interleaved with the gate lines of the second group, and wherein the first eye image is either of a left-eye image or a right-eye image of the 3D image.

20. The method of claim 19, further comprising:

providing, by the gate driver, third gate signals to the first group of gate lines in a first sub-frame of a second frame;

providing, by the data driver, third data signals for a second eye image of the 3D image through the data lines to the pixels connected to the first group of gate lines in synchronization with the third gate signals;

providing, by the gate driver, fourth gate signals to the second group of gate lines in a second sub-frame of the second frame; and providing, by the data driver, fourth data signals for the second eye image through the data lines to the pixels connected to the second group of gate lines in synchronization with the fourth gate signals, wherein the second eye image is the other of the left-eye image or the right-eye image of the 3D image.

* * * * *